United States Patent [19]

Satoh

[11] 4,449,026

[45] May 15, 1984

[54] HIGH FREQUENCY AND STEAM HEATING METHOD AND APPARATUS

[75] Inventor: Seiichi Satoh, Fujinomiya, Japan

[73] Assignee: Tokyo Shibaura Denki Kabushiki Kaisha, Kawasaki, Japan

[21] Appl. No.: 471,061

[22] Filed: Mar. 2, 1983

Related U.S. Application Data

[63] Continuation of Ser. No. 248,283, Mar. 27, 1981, abandoned, which is a continuation of Ser. No. 35,641, May 3, 1979, abandoned.

[30] Foreign Application Priority Data

May 8, 1978 [JP] Japan ..... 53-54326

[51] Int. Cl.[3] ..... H05B 6/66

[52] U.S. Cl. ..... 219/10.55 B; 219/10.55 R

[58] Field of Search ..... 219/10.55 B, 10.55 R, 219/10.55 A, 10.55 M, 10.55 E

[56] References Cited

U.S. PATENT DOCUMENTS 4,137,442 1/1979 Tateda ..... 219/10.55 B

FOREIGN PATENT DOCUMENTS 1029124 5/1966 United Kingdom .
1212365 11/1970 United Kingdom .
1332122 10/1973 United Kingdom .
1499279 1/1978 United Kingdom .
1515976 6/1978 United Kingdom .
1540295 2/1979 United Kingdom .

*Primary Examiner*—B. A. Reynolds
*Assistant Examiner*—Philip H. Leung
*Attorney, Agent, or Firm*—Cushman, Darby & Cushman

[57] ABSTRACT

A high frequency heating apparatus comprising an oven for accommodating an object to be cooked, a steam generator for supplying steam into the oven, a high frequency generator for supplying high frequency waves into said oven for cooking, and wherein said high frequency generator and said steam generator are alternately driven to cook the object with alternate heating of high frequency wave and steam.

3 Claims, 27 Drawing Figures

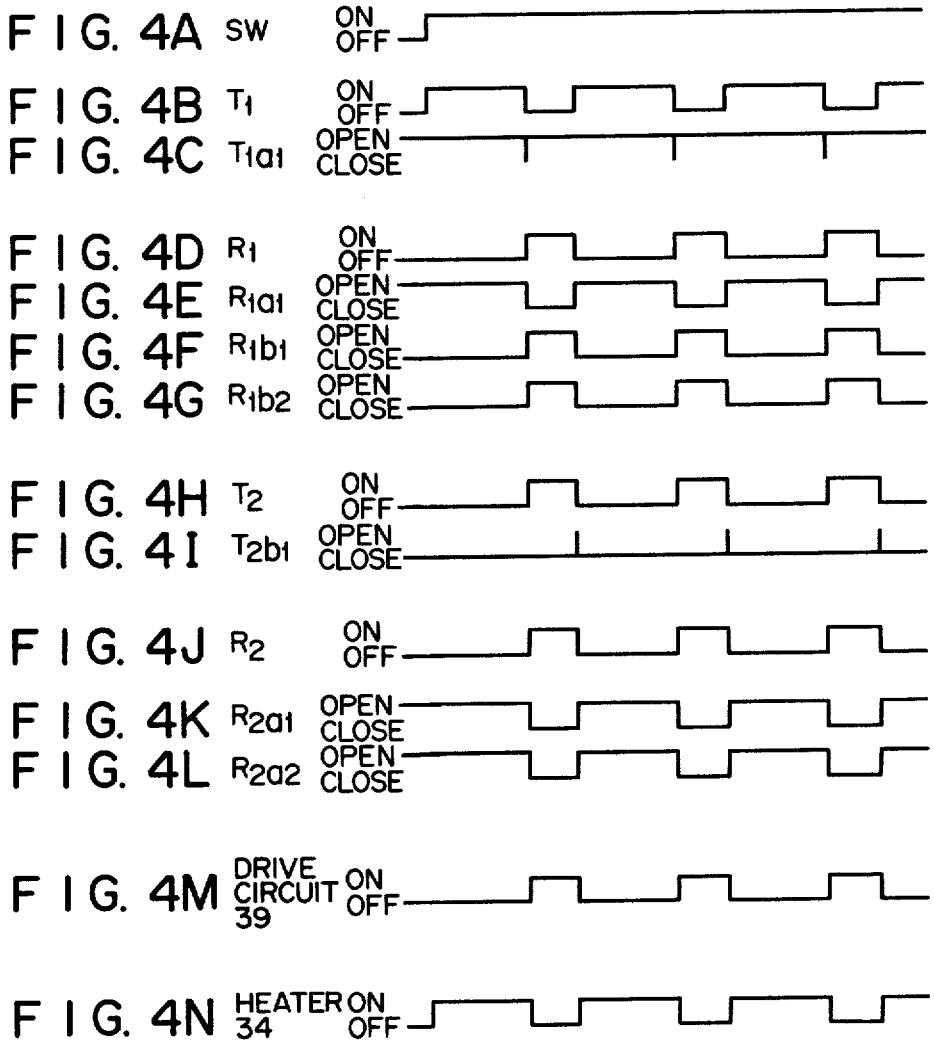
FIG. 4A SW ON OFF
FIG. 4B T1 ON OFF
FIG. 4C T1a1 OPEN CLOSE
FIG. 4D R1 ON OFF
FIG. 4E R1a1 OPEN CLOSE
FIG. 4F R1b1 OPEN CLOSE
FIG. 4G R1b2 OPEN CLOSE
FIG. 4H T2 ON OFF
FIG. 4I T2b1 OPEN CLOSE
FIG. 4J R2 ON OFF
FIG. 4K R2a1 OPEN CLOSE
FIG. 4L R2a2 OPEN CLOSE
FIG. 4M DRIVE CIRCUIT 39 ON OFF
FIG. 4N HEATER 34 ON OFF FIG. 5A SW
FIG. 5B HIGH FREQUENCY GENERATOR
FIG. 5C STEAM GENERATOR
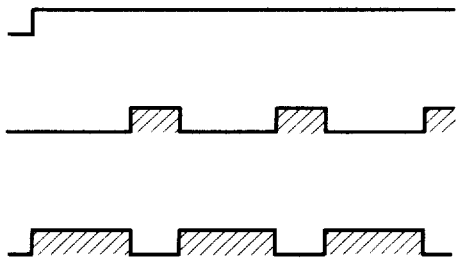
FIG. 6
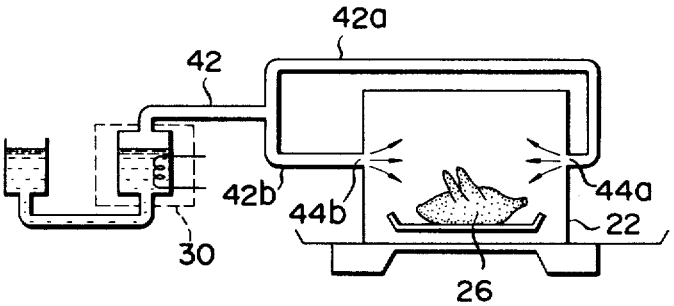
FIG. 7
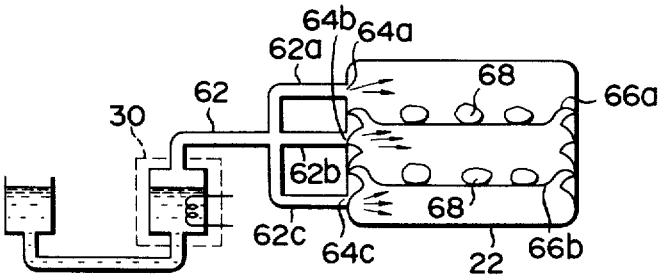

FIG. 8
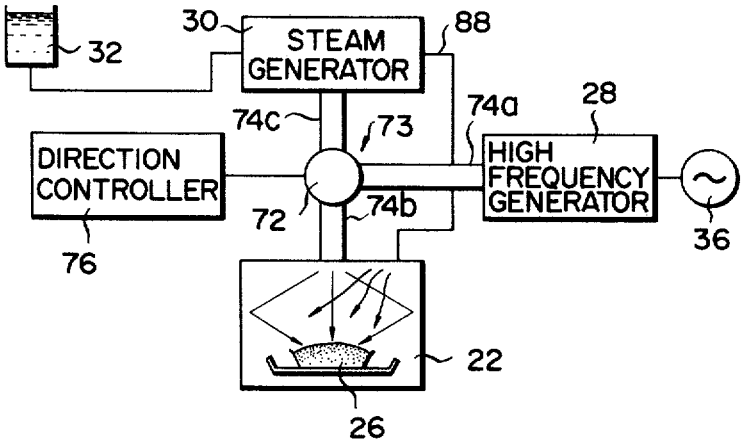
FIG. 9
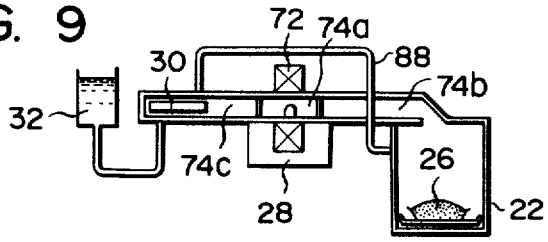
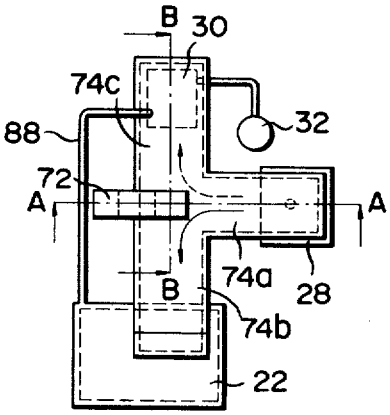
FIG. 10

HIGH FREQUENCY AND STEAM HEATING METHOD AND APPARATUS

This is a continuation of application Ser. No. 248,283, filed on Mar. 27, 1981, abandoned with the filing of this application, which, in turn, is a continuation of application Ser. No. 35,641, filed May 3, 1979, now abandoned.

This invention relates to high frequency heating apparatus, and more particularly to an improvement in high frequency heating apparatus for cooking wherein high frequency wave heating and steam heating are utilized.

A conventional high frequency heating apparatus has the advantage that it can shorten a cooking time. However, when high frequency heating alone is used to cook, the food becomes dry with the result that it has an unsatisfactory taste.

There has been used another heating mode wherein steam heating alone is used to heat an object for cooking. Steam heating, however, has the drawback that it requires a relatively long time to sufficiently cook the entire object to the core thereof.

In view of the above circumstances, there has been recently developed a high frequency heating apparatus which utilizes high frequency heating and steam heating.

In this conventional heating apparatus, however, consideration is neither given to the power consumption needed for high frequency or steam heating, nor is the cooked food satisfactory.

It is advisable to perform high frequency heating simultaneously with the steam heating in order to heat an object to be cooked without causing water loss. In this case, more than 1 (Kw) of power is required for each of the high frequency heating and steam heating. This is very uneconomical. Further, steam attaches to the surface of the cooked food with the result that it become watery.

An object of the invention is to provide a high frequency heating apparatus of the type wherein a predetermined cooking program is incorporated and wherein steam heating and high frequency heating are alternately conducted.

Another object of the invention is to provide a high frequency heating apparatus of the type wherein steam heating is first conducted for a predetermined period of time and then high frequency heating and steam heating are alternately conducted.

Still another object of the invention is to provide a high frequency heating apparatus of the type which includes a control circuit for making such control as would permit an alternate operation of the high frequency heating and the steam heating.

A further object of the invention is to provide a high frequency heating apparatus of the type wherein a common power source is used for both the high frequency heating and steam heating, thereby to cause reduction in power consumption.

This invention can be more fully understood from the following detailed description when taken in conjunction with the accompanying drawings, in which:

FIGS. 4A to 4N show a set of wave forms to aid in explaining the operation of the control circuit in FIG. 3;

FIGS. 5A to 5C show a set of timing diagrams useful in explaining the operation of the apparatus shown in FIG. 1;

FIGS. 6 and 7 show other embodiments of the high frequency heating apparatus according to the invention;

FIG. 8 shows a block diagram of still another embodiment of the apparatus according to the invention;

FIG. 9 shows a longitudinal cross sectional view of the embodiment shown in FIG. 8;

FIG. 10 shows a cross sectional view of the apparatus in FIG. 8 which viewed from above.

Figure 1:
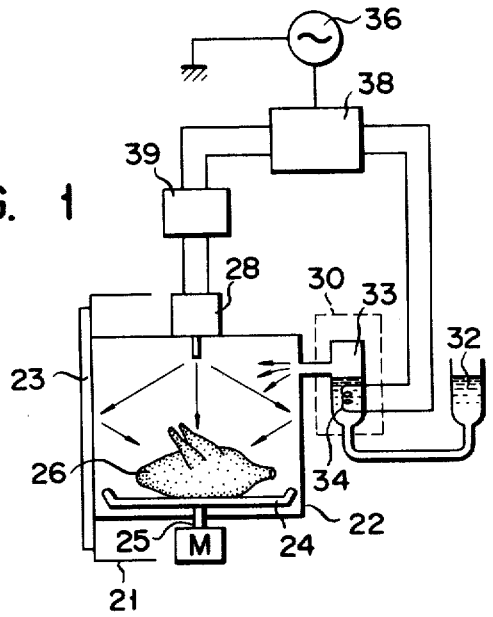
FIG. 1 shows a schematic diagram of a high frequency heating apparatus which is an embodiment according to the invention.

Reference will first be made to FIG. 1 schematically illustrating the construction of an embodiment of a high frequency heating apparatus according to the invention. Numeral 21 designates a housing of the heating apparatus. A door 23 is provided on the front opening of the housing 21 to open or close the opening. A rotary dish 24 is disposed inside an oven 22 on which an object 26 to be cooked is placed. The rotary dish 24 is removably provided on a driving shaft 25 extending through the bottom wall of the oven 22. The rotary dish 24 is preferably made of hard glass or porcelain which permits the passing of high frequency waves for uniform cooking of the object 26.

Figure 2:
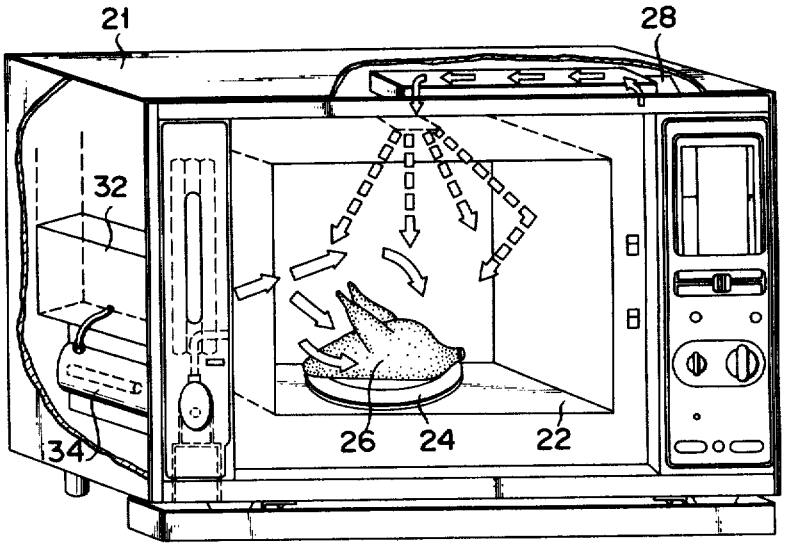
FIG. 2 shows an external appearance of the high frequency heating apparatus according to the invention, which is illustrated partly broken.

A high frequency generator 28 is installed on the top of the oven 22. A steam generator 30 for supplying steam into the oven 22 is provided outside the oven 22, the generator 30 comprising a boiler 33, a tank 32 reserving water and supplying it to the boiler 33, and a heater used as a heat source for heating the water in the boiler 33 for producing steam. An actual structure of the steam generator 30 is shown in FIG. 2. The high frequency generator 28 and steam generator 30 are supplied with electric power from a single common power source 36. The power feeding is so controlled by a control circuit 38 (later described) that power is alternately supplied to the high frequency generator 28 and the steam generator 30.

Figure 3:
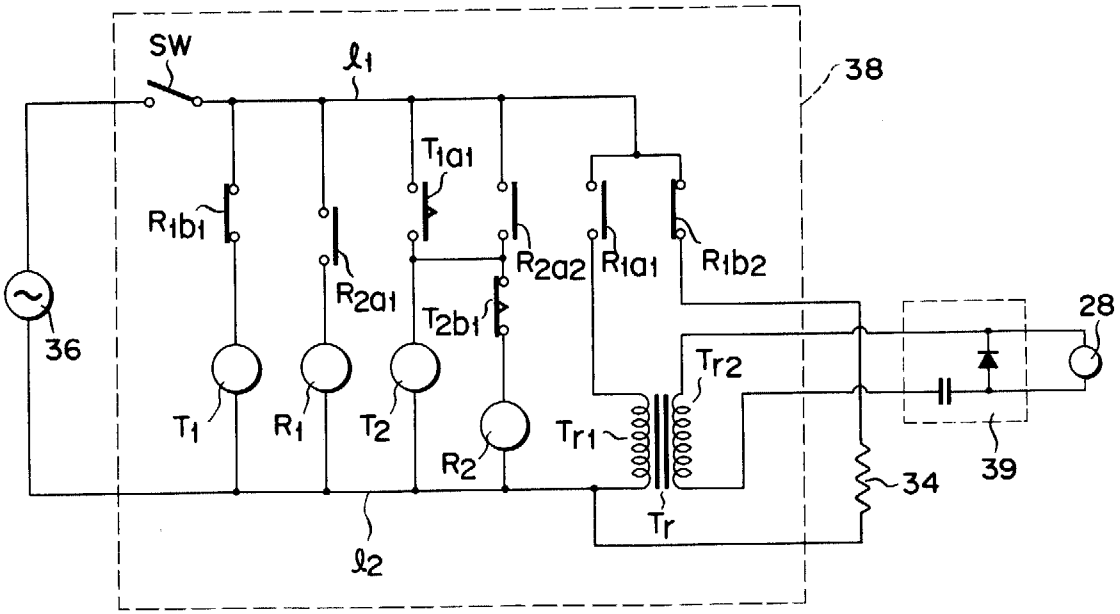
FIG. 3 shows a wiring diagram of a control circuit used in the apparatus shown in FIG. 1.

FIG. 3 shows a circuit diagram of the control circuit 38. In the circuit diagram between lines $l_1$ and $l_2$, various circuits are inserted. The first is a series circuit having a power switch SW and a power source 36. The power switch SW is opened or closed in interlocking relation, with a timer for setting a predetermined cooking time. Though the timer is not shown, it may be of known type. The second is a timer T1 for presetting a time permitting a current flow into the heater 34 of the steam generator 30, and a normally close contact R1b1 of a relay R1. The third is a series circuit having the relay R1 and a normally open contact R2a1 of a relay R2. The fourth is a series circuit having another timer T2 for presetting a time allowing a current flow into the high frequency generator 28, and a normally open contact T1a1 of the timer T1. The fifth is a series circuit having the relay R2, a normally close contact T2b1 of the timer T2 and a normally open contact R2a2 of the relay R2. A common line connects a joint point between the normally open contact T1a1 and the timer T2 to another joint point between the normally open contact R2a2 and the contact T2b1. The sixth is a series circuit having a primary winding Tr1 of a transformer Tr and a normally open contact R1a1 of the relay R1. The seventh is a series circuit having a heater 34 of the steam generator 30 and a normally close contact R1b2 of the relay R2. The secondary winding Tr2 of the winding Tr is coupled to a drive circuit 39 for the high frequency generator 28. As indicated above, timers T1 and T2 are both presettable so that the duty cycles of steam cooking and high frequency cooking can be independently controlled.

The operation of the apparatus thus constructed will be described with reference to FIGS. 4A to 4N depicting a set of timing diagrams. In the figure, in a high level state, the power switch SW is on, and the timers T1 and T2, the relays R1 and R2, the high frequency generator 28 and the steam generator 30 are all energized, and the contacts R1a1, R1b1, R1b2, R2a1 and R2a2 and the timer contacts T1a1 and T2b1 are all open, and the drive circuit 39 and the heater 34 are ON.

First, a desired cooking time is set by an operator, for example, a housekeeper depending upon the kind of food.

Then the switch SW of the control circuit 38 is turned on to effect power supply from the power source 36 to the circuitry between the lines $l_1$ and $l_2$. Upon the power feeding, current flows through the normally close contact R1b2 into the heater 34, so that the heater 34 heats the water in the boiler 33 to evaporate the water to produce steam for supply into the oven 22. In this way, the high frequency heating apparatus operates as a steam generator. The power feeding also enables the timer T1 through the normally close contact R1b1 of the relay R1. As the set time of the timer T1 lapses, the contact T1a1 of slow response type is closed. Closing the timer contact T1a1 results in energization of the timer T2. The close of the timer contact T1a1 also results in energization of the relay R2 through the common line and the contact T2b1 of slow response type of the timer T2. The energization of the relay R2 in turn closes the associated contacts R2a1 and R2a2. The close of the contact R2a1 energizes the relay R2 which in turn is self-held. The close of the normally open contact R2a1 energizes the relay R1. The energization of the relay R1 closes its normally open contact R1a1 and opens its normally close contacts R1b1 and R1b2. The open of the contact R1b2 shut off the current flow into the heater 34 to stop the steam generator 30. The close of the normally open contact R1a1 forms a current flow path continuous to the primary winding Tr1 of the transformer Tr. The result is that power is supplied to the drive circuit 39 of the high frequency generator 28 and the high frequency generator 28 now operates. The release of the normally close contact R1b1 shuts off the current feeding to the timer T1 to deenergize the timer T1, and thus to release the contact T1a1 of the timer T1. After the normally open contact T1a1 is open, the relay R2 is supplied with power through a close path including the self-sustaining contact R2a2 and the contact T2b1 and maintained in enable condition. Timer T2 is supplied with power from the power source 36 through the contact R2a2 and maintained in enable condition. After the set time of the timer T2 lapses since the close of the contact R1a1, the slow response type normally close contact T2b1 of the timer T2 is released. The release of the contact T2b1 deenergizes the relay R2 and then releases the contacts R2a1 and R2a2. The open of the contact R2a1 deenergizes the relay R1. The open of the contact R2a2 deenergizes the timer T2 to close the contact T2b1. The deenergization of the relay R1 also closes both the contacts R1b1 and R1b2 while opens the contact R1a1. The result is that the current path continuous to the drive circuit 39 for the high frequency heater 28 is broken to stop the power supply thereto while the current path to the heater 34 of the steam generator 30 is again formed. The high frequency heating apparatus is now returned to its initial condition. The steam and the high frequency wave cooking operations are alternately repeated so long as the switch SW is closed. After the predetermined set time for cooking lapses, the power switch SW is turned off to stop the cooking operation of the apparatus.

FIGS. 5A to 5C show operation cycles of the switch 34 opened, the steam generator 30 with the heater 34 and the high frequency generator 28 with the drive circuit 39, respectively.

As described above, the control circuit 28 controls the high frequency heating apparatus so as to operate alternately as a steam generator and a high frequency generator, starting first the steam generator function.

The steam cooking operation externally heats the food adding water to the surface of the food. In the succeeding high frequency cooking in a short time, the food is internally heated while the water is evaporated from the food surface. In this case, an excessive dehydration from the food is prevented because of the water added in the preceding steam cooking. If the steam and high frequency operations are properly repeated in accordance with the kind of food, the food may be cooked well.

With the high frequency heating apparatus according to the invention, the steam cooking operation is first performed and then the high frequency cooking operation so that the cooking time is shortened saving power consumption.

In our experiment, a bun with meat filling was cooked by using the high frequency heating apparatus according to the invention. The cooking time for the bun was 7 to 8 minutes. The experiment was conducted under the following conditions. The output of the high frequency generator 30 is 60 W. As shown in FIG. 5, the steam cooking is first made followed by the high frequency cooking. One steam cooking time for 30 seconds and one high frequency cooking time for 15 seconds are alternately repeated and seven minutes and 30 seconds of the alternate cycle were needed for the cooking.

Turning now to FIG. 6, there is shown another embodiment of the high frequency heating apparatus according to the invention. A major difference of this embodiment from that in FIG. 1 is a steam supply tube 42 for leading steam from the generator 30 to the oven 22. In the drawing of the figure, the control circuit and the high frequency generator and the like are omitted for simplicity of illustration. As shown, the steam supply tube 42 is bifurcated into two tubes **42*a* and 42*b* which are open into the oven 22 at the inner walls of the oven 22 facing to each other. The opening of those tubes are denoted as 44*a* and 44*b*, respectively. With this tube arrangement, the food 26** on the dish is supplied with steam from both sides, so that the food may be uniformly cooked, resulting in reduction of the cooking time. Accordingly, this embodiment is effective when it is applied for food with large volume or large surface area.

FIG. 7 shows another embodiment of the high frequency heating apparatus according to the invention. The embodiment employs three branched tubes **62*a*, 62*b* and 62*c* branching from a steam supply tube 62**. The openings 64a to 64c of those branched tubes are opened into the oven 22 with an arrangement of the openings vertically along one of the inner walls of the oven 22. Dishes 66a and 66b are disposed between the adjacent openings, as shown. Such increased number of dishes enables more number of foods to be made at a time. Further, each food on the dish is supplied with steam from the upper and the lower sides so that the uniform cooking and the cooking time are further improved.

The steam discharging opening may be shaped gradually outwardly expanding toward the oven, taking a shape like a funnel. Such funnel shaped openings diffuse the discharged steam widely so that the food may be further uniformly cooked.

FIG. 8 illustrates still another embodiment of the high frequency heating apparatus according to the invention. Like numerals are used to designate like portions or equivalent portions in FIG. 1. The explanation to follow is emphasized on the portions not shown in the FIG. 1 embodiment. The outstanding feature of this embodiment is a microwave circulator 72 which directs the high frequency waves from the high frequency generator 28 toward the oven 22 for food heating or the steam generator 30 as a heat source. In FIG. 8. The high frequency generator 28 coupled with a power source 36 produces the high frequency waves such as microwaves. The high frequency waves fed from the generator 28 is guided through a wave guide 74a to the microwave circulator 72 which is also coupled with wave guides 74b and 74c connecting to the oven 22 and the steam generator 30. A direction controller 76 connecting to the microwave circulator 72 provides a high frequency wave path from the high frequency generator 28 through the wave guide 74b to the oven 22 or another path from the high frequency generator 28 through the wave guide 74c to the steam generator 30. In this embodiment, the steam generator 30 must be made of material permitting high frequency waves to pass therethrough with low dielectric loss.

Figure 11:
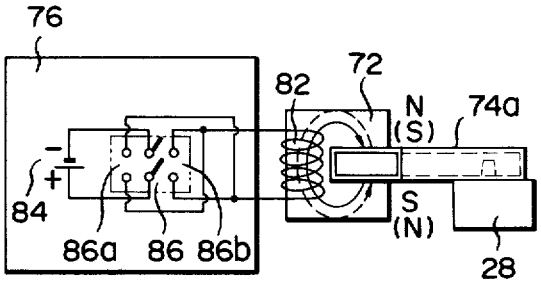
FIGS. 11 and 12 respectively show cross sectional views taken along lines A—A and B—B.
Figure 12:
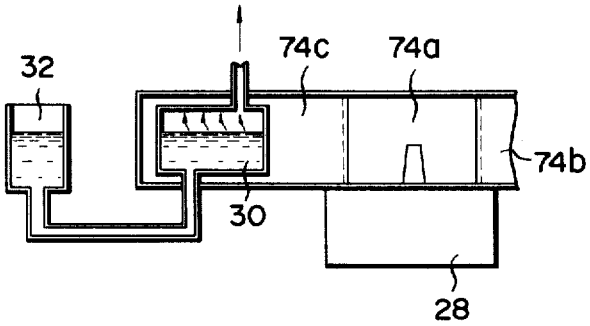

The plan view and the side view of the embodiment shown in FIG. 8 is illustrated in cross sectional manner. FIGS. 9 and 10 omit the direction controller 76 in the illustration. The cross section taken along line A—A in FIG. 10 is illustrated in FIG. 11 with addition of the circuit diagram of the direction controller 76. FIG. 12 illustrates the cross section taken along line B—B in FIG. 10.

The embodiment shown in FIG. 8 will be further elaborated with reference to FIGS. 9 to 12. The high frequency wave generated by the high frequency generator 28 travels to reach a branch point 73 where it is directed toward the oven 22 or the steam generator 30 under the control of the controller 76. As well illustrated in FIG. 11, the microwave circulator 72 comprises a deflection coil 82 disposed in the vicinity of the branch point 73 of the wave guide. The deflection coil 82 is connected to the controller 76 which comprises a DC power source 84 and a double pole double throw switch 86. In changing the high frequency wave direction, a movable contact of the switch 86 is turned to a fixed contact 86a or 86b to change the direction of magnetic field as shown in dotted or solid line so that the high frequency wave is directed to the wave guide 74b or 74c. It is desirable that the switch 86 is opened or closed in interlocking relation with a timer (not shown) as in the case of FIG. 1. The high frequency wave passed through the wave guide 74b is supplied into the oven 22 for heating the food. The high frequency wave passed through the guide 74c is applied to the steam generator 30 to heat the water contained in the generator tank. The heated water is evaporated to produce steam lead into the oven 22. A properly controlled current fed into the deflection coil 82 provides a proper shunt ratio of the branching high frequency wave into the respective wave guides.

When a magnetron is used for the high frequency generator 28, cooling air after cooling the magnetron, that is to say, heated cooling air, may be introduced into the tank 32 for preheating the water contained therein, through a proper air guide means. Since water contained in the tank 32 is preheated using a high frequency wave, this method eliminates the need for particular consideration of the heat radiation into the peripheral portions. This leads to simplification of the apparatus construction and facilitates the insulation of various parts or portions of the apparatus.

As described above, the high frequency heating apparatus according to the invention alternately serves as a steam generator and a high frequency generator with given alternate operation time intervals. The food may be cooked internally and externally so that the uniform cooking is obtained. Further, in the alternate operation, the steam cooking goes ahead of the high frequency wave cooking. For this, drying of the surface of the food in the high frequency wave cooking operation mode may be prevented. The alternate operation shortens the cooking time and thus saves power consumption.

What is claimed is:

1. A high frequency heating apparatus comprising:
a housing;
an oven provided within said housing;
a high frequency generator provided within said housing for supplying a high frequency wave into said oven;
a steam generator provided within said housing for supplying steam into said open, the steam generator utilizing as a heat source a high frequency wave generated by said high frequency generator;
microwave circulator means for selectively directing a high frequency wave from said high frequency generator to said oven or said steam generator; and
a control circuit including:
a steam generator timer for setting an energization period of said high frequency generator, and
a high frequency generator timer for setting an energization period of said high frequency generator, and
drive means for driving said steam generator before said high frequency generator in each cooking cycle and for independently controlling the energization periods of said high frequency generator and said steam generator in response to the operations of said high frequency generator timer and said steam generator timer, respectively.

2. A high frequency heating apparatus according to claim 1, wherein said microwave circulator means comprises wave guides for guiding a high frequency wave from the high frequency generator to said steam generator and said oven, and electromagnetic means provided at a predetermined point on said wave guides.

3. A high frequency heating apparatus comprising:
a housing;
an oven provided within said housing;

a high frequency generator provided within said housing for supplying a high frequency wave into said open;

a steam generator provided within said housing for supplying steam into said oven, the steam generator utilizing as a heat source a high frequency wave generated by said high frequency generator, and the steam generated by said steam generator being conducted into said oven through openings made in both side walls of said oven; and a control circuit including:

a steam generator timer for setting an energization period of said steam generator, a high frequency generator timer for setting an energization period of said high frequency generator, and drive means for driving said steam generator before said high frequency generator in each cooking cycle and for independently controlling the energization periods of said high frequency generator and said steam generator in response to the operations of said high frequency generator timer and said steam generator timer, respectively.

* * * * *